US006739020B1

(12) United States Patent
Morawetz

(10) Patent No.: US 6,739,020 B1
(45) Date of Patent: May 25, 2004

(54) DOOR HINGE WITH AN INTEGRATED DOOR STOP

(75) Inventor: Richard Morawetz, Wuppertal (DE)

(73) Assignee: Edscha AG, Remscheid (DE)

( * ) Notice: Subject to any disclaimer, the term of this patent is extended or adjusted under 35 U.S.C. 154(b) by 0 days.

(21) Appl. No.: 10/129,491

(22) PCT Filed: Nov. 3, 2000

(86) PCT No.: PCT/DE00/03890

§ 371 (c)(1),
(2), (4) Date: May 2, 2002

(87) PCT Pub. No.: WO01/33018

PCT Pub. Date: May 10, 2001

(30) Foreign Application Priority Data

Nov. 4, 1999 (DE) ..... 199 53 077

(51) Int. Cl.[7] ..... E05D 11/10
(52) U.S. Cl. ..... 16/334; 16/342; 16/337
(58) Field of Search ..... 16/334, 330, 322, 16/329, 331, 332, 352, 353, 312, 313, 314, 300, 321, 342, 337

(56) References Cited

U.S. PATENT DOCUMENTS

| | | | | | |
|---|---|---|---|---|---|
| 4,701,978 | A | * | 10/1987 | Selmer | 16/380 |
| 5,079,798 | A | | 1/1992 | Burke et al. | 16/252 |
| 5,412,842 | A | * | 5/1995 | Riblett | 16/334 |
| 5,638,579 | A | * | 6/1997 | Tenney | 16/338 |
| 5,918,347 | A | * | 7/1999 | Morawetz | 16/322 |
| 6,073,308 | A | * | 6/2000 | Linnenbrink et al. | 16/334 |
| 6,314,614 | B1 | | 11/2001 | Kuehl | 16/342 |
| 6,442,800 | B1 | * | 9/2002 | Morawetz | 16/337 |
| 6,481,056 | B1 | * | 11/2002 | Jesse | 16/334 |

FOREIGN PATENT DOCUMENTS

| | | | | |
|---|---|---|---|---|
| DE | 1902392 | | | 6/1964 |
| DE | 2205940 | | | 8/1972 |
| DE | 2923179 | | | 12/1980 |
| DE | 4426425 | | | 2/1995 |
| DE | 93143257 | | | 3/1995 |
| DE | 9421611 | | | 5/1996 |
| DE | 29611580 | | | 2/1997 |
| DE | 19625556 | | | 1/1998 |
| DE | 19631028 | | | 2/1998 |
| DE | 19717117 | | | 10/1998 |
| DE | 29821472 | U1 | * | 12/1998 |
| DE | 19811108 | | | 2/1999 |
| DE | 29914042 | U1 | * | 8/1999 |
| DE | 29807308 | | | 9/1999 |
| GB | 1362089 | | | 7/1974 |
| GB | 2001699 | A | * | 2/1979 |
| GB | 2329930 | A | * | 4/1999 |
| WO | WO 99/42689 | | * | 8/1999 |

* cited by examiner

*Primary Examiner*—Chuck Y. Mah
(74) *Attorney, Agent, or Firm*—Davidson, Davidson & Kappel, LLC

(57) ABSTRACT

The invention relates to a door hinge for a motor vehicle door. Said door hinge comprises a first and a second hinge half (1, 2) each of which can be fastened either on one of the door fastening elements, on the door or on the door pillar respectively. The hinge also comprises a hinge shaft (3) that is received by the lugs of the one hinge half (1) in a running fit and by the other hinge half (2) in a stationary manner and that links the two hinge halves (1, 2) so that they can be swiveled. The door hinge is further provided with an integrated door stop unit by means of which the one hinge half can be arrested with respect to the other hinge half under the pre-load of a spring (7), said spring forcing a tappet (5) against a profiled circumferential section of the hinge shaft. Said tappet (5) interacts with the profiled circumferential section, thereby defining a frictional force for the door hinge.

11 Claims, 5 Drawing Sheets

DOOR HINGE WITH AN INTEGRATED DOOR STOP

BACKGROUND OF THE INVENTION

The invention relates to a door hinge with an integrated door stop for a vehicle door.

If a motor vehicle door is to be fixed in a certain opening position, a door stop is used for this purpose. Door stops which are integrated in door hinges provide compact solutions in this regard. German Offenlegungsschrift DE 198 11 108 to A1 discloses a door hinge, which is described at the beginning, with an integrated door stop, in which the door stop comprises a spring element which engages in latching positions on a driver plate and the door hinge part (door console) is connected in a rotationally fixed manner to the hinge shaft (hinge pin) and the hinge shaft is connected in a rotationally fixed manner to the driver plate. In the case of a door stop of this type, which uses a very large, S-shaped torsion spring as spring element, the door can only be fixed at door position angles predetermined by the latching positions.

The door hinge with an integrated door stop is disclosed in German Patent Application No. 44 26 425, in which a hinge part arranged at the door and a hinge part arranged at the car body are pivotally connected by a bearing. A profile disc is formed and arranged like a pitch circle around the bearing, the profile of which shows radially extending elevations and depressions between it on the side opposite of the swicelling bearing. A roller is arranged at the top of a convex gliding part in such a manner that it is prestressed by a compression spring and pressed radially against the profile. A braking and holding momentum is exercised on the door part by the engagement of the roller into the depressions of the profile.

The technical problem on which the invention is based is to construct a hinge with an integrated door stop which permits an infinitely variable fixing of the door in any desired opening position and permits the motor vehicle door to be moved from the opening position and after any desired stop both in the opening and in the closing direction just using a predetermined force.

SUMMARY OF THE INVENTION

In the case of the proposed door stop, the braking or retaining moment for the motor vehicle door is applied by a frictional moment between the two hinge parts. To this end, the pressure ram, which is guided radially in the hinge part with a running fit, and the circumferential profiling of the hinge shaft, which is fixed in a rotationally secure manner with respect to the other hinge part, interact. In the process, the required frictional force is produced by a spring and is determined by the selection of the spring chararacteristic. If the door is to be opened by up to 90° in a manner such that it can be fixed, the circumferential profiling of the hinge shaft has to be arranged at least on a quarter of the shaft circumference in the region of the possible effectiveness of the pressure ram and therefore of the projection of the radial hole. The profiling has contours, the distance of which from the shaft axis is smaller than the shaft radius, with the result that the spring-loaded pressure ram moves forward in contact with the profiled contour and therefore fixes the shaft with respect to neighboring contours at a greater distance from the shaft axis and with higher frictional force. If the non-profiled circumferential section of the hinge shaft extends over more than half of the shaft circumference, the shaft is reliably guided peripherally in the gudgeon.

Depending on the desired fixing characteristic, the profiling can have different contours. If the door is to be fixed in an infinitely variable manner, the transitions between the sectors at a different distance from the shaft axis have to be continuous with minimal differences in distance. The transitions have therefore to be gentle or progressive or gradual.

In embodiments, in which the profiling of the hinge shaft in a number of sectors situated peripherally next to one another have contours which are matched to the profile of that end surface of the pressure ram which interacts in each case with the contour, the contour of the end surface of the pressure ram for the infinitely variable fixing within latching regions has also to be designed as a contour which only changes in a gentle manner, or is a planar contour.

In an embodiment, in which the contours of the profiling of the shaft circumference have, for at least one sector, a graduated circle contour having a respectively smaller radius in comparison with the front sector in the opening direction of rotation of the door, the door can be fixed in an infinitely variable manner in every opening or closing position if the frictional force between the pressure rams and hinge shaft is set appropriately. In this case, the profile of the pressure ram end surface is plane and parallel to the shaft axis. The door is fixed in an infinitely variable manner in every desired position as soon as the frictional force between the pressure ram and hinge shaft has been appropriately set. If the radius of the sector corresponding to the closing position is smaller by at least the spring travel of the compression spring than the radius of the adjacent sector, the compression spring is relaxed in the closing position, with the result that the threaded cylinder can advantageously be set in the closing position with a very low torque.

It has been shown in tests that the interacting contact sections on the pressure ram end and the graduated circle contour of the shaft circumference are not subject to any particular wear. This is firstly because the contact sections are relatively large, but secondly and especially also because the pressure ram always rotates about its own axis when acting on the shaft surface. This rotation is to be attributed to the fact that in spite of exact dimensions and installation dimensions extremely small tolerances are in play and therefore have the effect that the forces between the respectively symmetrical sections of the interacting parts are not absolutely the same and not nullify one another.

The introduction of a central blind hole in the end surface of the pressure ram has an advantageous effect on the wear behavior. If the blind hole is arranged offset eccentrically by less than its radius, this assists the rotation of the pressure ram about its own axis, since the difference between the contact sections on both sides of the blind hole reinforces the heterogeneity of the compressive forces in a specific manner.

An exemplary embodiment, in which the hinge shaft has, in the central section in which the circumferential profiling is also arranged, an axially running outer profile and an external sleeve which has an inner profile matched in a form-fitting manner to the outer profile of the shaft, has the advantage that the hinge shaft does not have to be machined in its entirety in order to apply the circumferential profile. Particularly if that subsection of the sleeve which has the circumferential profiling is a single-piece latching sleeve, the circumferential profiling can be restricted to this latching sleeve. The latching sleeve is then only of the length which corresponds to the corresponding extent of the pressure ram. If the central section of the hinge shaft is of longer length, corresponding sleeve sections having a circular circumference can also be arranged on both sides of the latching sleeve. If the latching profile is to be changed, the latching sleeve has merely to be interchanged in order to achieve this. This construction also permits the best suited material in each case or the most cost-effective material which is suitable for the particular requirements to be selected for the particular regions of hinge shaft and sleeves.

An exemplary embodiment, in which the compression spring has a central opening into which a pin, which is arranged on the end of the threaded cylinder or in the back of the pressure ram, protrudes flush with the edge, in which case a recess corresponding to the cross section of the pin is present in the respective other part without a pin, has the advantage that the compression spring is guided exactly in the radial hole, with the result that tilting of the compression spring and a nonuniform transmission of the spring force is avoided.

In one embodiment, in which the radial hole, which is accessible from the outside of the hinge tab, is arranged in the threaded cylinder with a screw profile which is accessible from outside, the threaded cylinder can also be adjusted in the installed state. Appropriate setting of the threaded cylinder causes the compression spring to be prestressed as desired and thereby enables the level of spring force to be appropriately changed. If, on the door assembly part to which the hinge part is fastened with a running fit, a motor is arranged in such a manner that its drive shaft engages, by means of a driver, into the screw profile of the threaded cylinder, this has the advantage that the level of spring force can be changed by motor.

DESCRIPTION OF THE DRAWINGS

The abovementioned advantages and further advantages of the invention are clarified in the description of exemplary embodiments which are illustrated in the attached drawing, in which.

DETAILED DESCRIPTION

Figure 1:
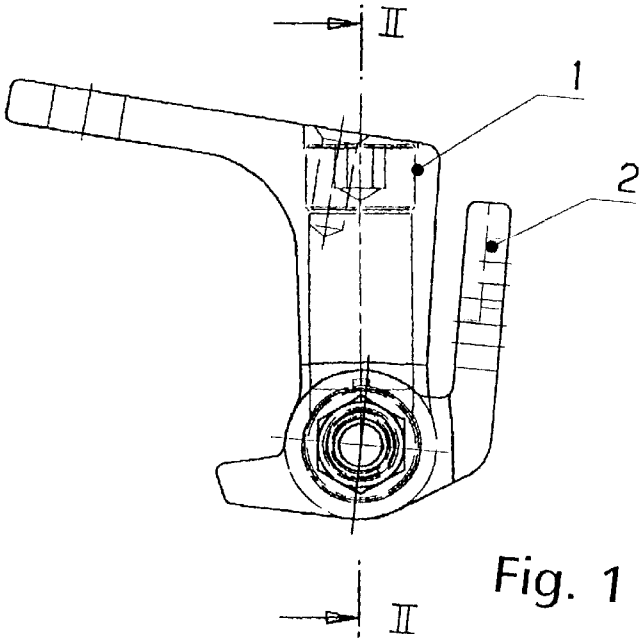
FIG. 1 shows a plan view of a door hinge with an integrated door stop.

The exemplary embodiments illustrated in the drawing are all based on the fact that the hinge part in which the hinge shaft 3 is held with a running fit is the bodywork hinge part 1, and that the hinge shaft 3 is held in a rotationally fixed manner in the door hinge part 2. FIG. 1 illustrates, in plan view, a door hinge with an integrated door stop in which the hinge shaft is held in the bodywork hinge part 1 with a running fit and is held in the door hinge part 2 in a rotationally secure manner.

Figure 2:
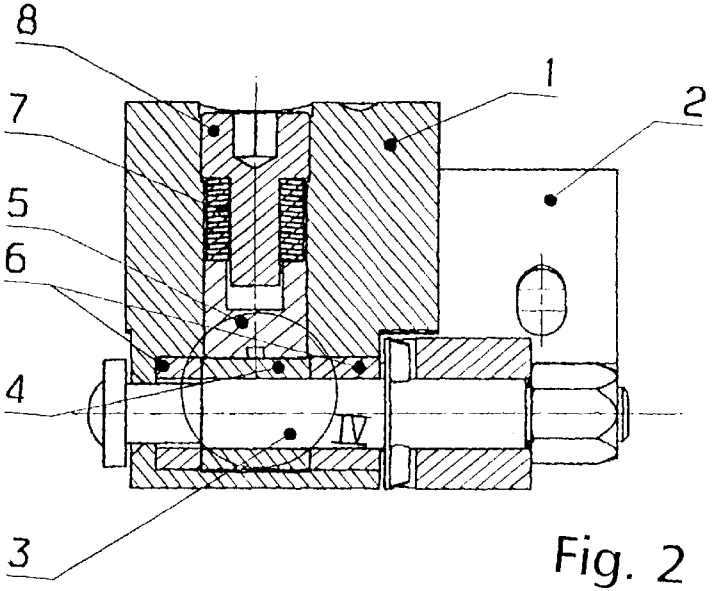
FIG. 2 shows a sectional illustration of the bodywork limb according to II—II in FIG. 1.

In FIG. 2, the view of the section II—II through the bodywork hinge limb according to FIG. 1 is illustrated. The hinge shaft 3 is held in the lug of the bodywork hinge part 1 and has sleeves 4, 6 in the section which is held in the lug of the bodywork hinge part 1. In this region, the hinge shaft 3 has an axially running outer profile. The sleeves, which are pushed onto the shaft, have an inner profile which is matched in a form-fitting manner to the shaft profile, as will be illustrated in greater detail further on with reference to FIG. 4. In the example illustrated, the sleeve 4 has a latching sleeve while the sleeves which are adjacent on both sides are guide bushings 6 having a round, unprofiled circumference. The limb of the bodywork hinge part 1 has a hole passing through it, said hole running radially with respect to the hinge shaft 3. That end of the radial hole which faces away from the hinge shaft 3 is closed by a threaded cylinder 8 which is guided moveably in an inner thread. A spring 7 is arranged between the pressure ram 5 and threaded cylinder 8, said spring pressing the pressure ram 5 in the direction of the hinge shaft 3. The radial hole is freely accessible from the outside of the bodywork hinge limb. A polygonal socket is embedded as a screw profile in that end surface of the threaded cylinder 8 which is accessible from outside.

The hinge shaft 3 has stepped, cylindrical sections, the upper section of which is held in the lug of the door hinge part and is adjoined by a collar-shaped section of larger diameter on which sections are provided with which the hinge shaft 3 is fastened in a rotationally secure manner against the lug of the door hinge part 2. The collar-shaped section is adjoined by a central section at whose lower end a pin of smaller diameter is arranged. The lug of the bodywork hinge part 1, in which the hinge shaft 3 is held with a running fit by the sleeves 4, 6 surrounding it, is designed as a stepped passage hole, on whose annular shoulder around the central passage hole the central, cylindrical section of the shaft is supported peripherally. The shaft pin protrudes through the central passage hole. In the exemplary embodiment illustrated, a rivet is embedded in the shaft pin for the purpose of axially securing the hinge shaft.

Figure 3B:
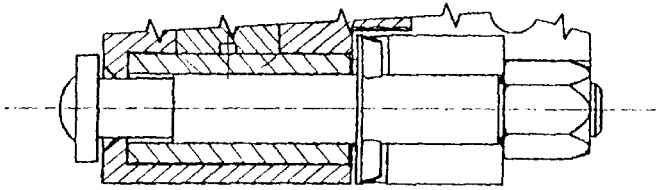
FIG. 3*b* shows a hinge shaft with a single-piece sleeve.
Figure 3A:
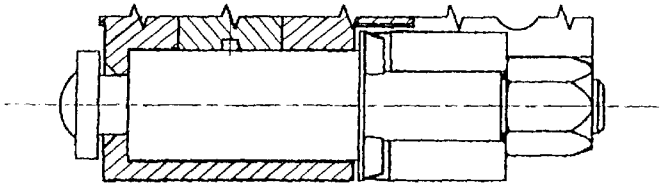
FIG. 3*a* shows a hinge shaft without a sleeve.

Whereas the sleeves 4, 6 of the hinge shaft in FIG. 2 are designed in three parts, the embodiment illustrated in FIG. 3*a*, corresponding to the lower part of FIG. 2, has a hinge shaft 3 without encasing sleeves or bushings. In FIG. 3*b*, the hinge shaft 3 is surrounded over its entire central section by a single-piece sleeve.

Figure 4:
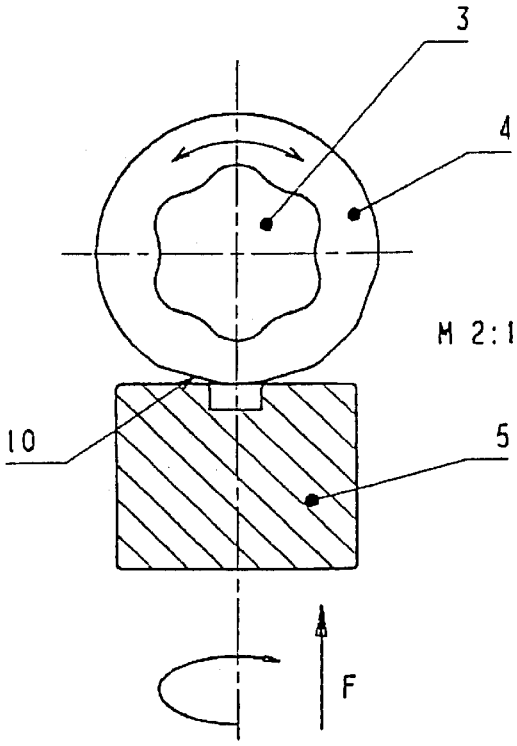
FIG. 4 shows an enlarged illustration of the detail IV from FIG. 2.

FIG. 4 illustrates the detail IV from FIG. 2 on an enlarged scale. It can clearly be seen that the hinge shaft 3 has a six-membered outer profile and the sleeve 4 has, in a complementary manner, an inner profile which is correspondingly designed in a form-fitting manner. A circumferential profiling is arranged on that circumferential section 10 of the sleeve 4 which faces the pressure ram 5.

Figure 5A:
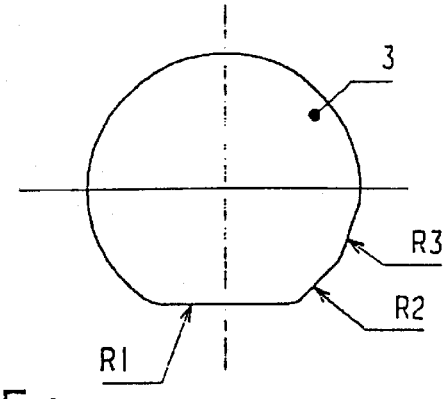
FIGS. 5*a* and 5*b* show contour variants of the profiled circumferential section.
Figure 5B:
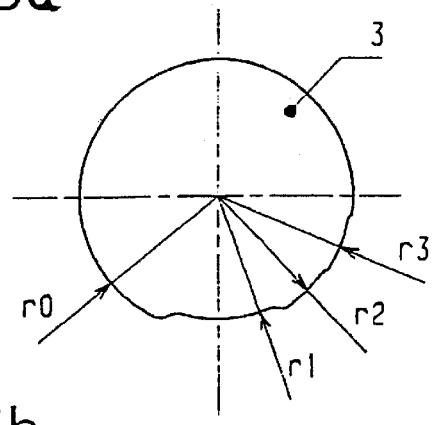

FIGS. 5*a* and 5*b* illustrates variants for the contour of a circumferential profiling of this type. FIG. 5*a* shows latching profiles R where $R_1$ is the latching profile which corresponds to the closing position of the door. The latches $R_2$ and $R_3$ correspond to certain positions of the door. The end surface of the pressure ram 5, which surface interacts with the contour of the profiled circumferential section 10, is designed in such a manner that it matches the latching contours R for the interaction. In the case of the secant-like flattened portion of the circumferential section, as shown in FIG. 5*a*, the end surface of the pressure ram 5 is plane and formed essentially parallel to the shaft axis. In the exemplary embodiment, which is shown in FIG. 5*b*, the contour of the profiled circumferential section 10 has, in three sectors, a graduated circle contour $r_1$, $r_2$ and $r_3$, the radii of which are in each case smaller than the shaft radius $r_0$ and decrease in the opening direction of rotation of the door. $r_0$ is thus larger than $r_3$ and $r_3$ is larger than $r_2$ and $r_2$ is larger than $r_1$ . The transistor from one sector to the next is gentle, which will be explained in more detail in conjunction with the description of FIG. 6. The graduated circle contours are configured in such a manner that a tangent on each graduated circle radius remains free from the remaining shaft contours.

The end surface of the pressure ram which interacts with the profile according to illustration b is plane and runs essentially parallel to the shaft axis. The sectors with the respective graduated circle radius correspond to the door position regions within which the door can be fixed in an infinitely variable manner. The radius $r_1$ of the sector corresponding to the closing position of the door is smaller by at least the spring travel f of the compression spring than the radius r2 of the adjacent sector. This results in the compression spring 7 being relaxed in the closing position of the door and the threaded cylinder 8 being able to be set with a very small torque in order to prestress the compression spring 7. The position of the pressure ram can thereby be adjusted with great ease.

Figure 6:
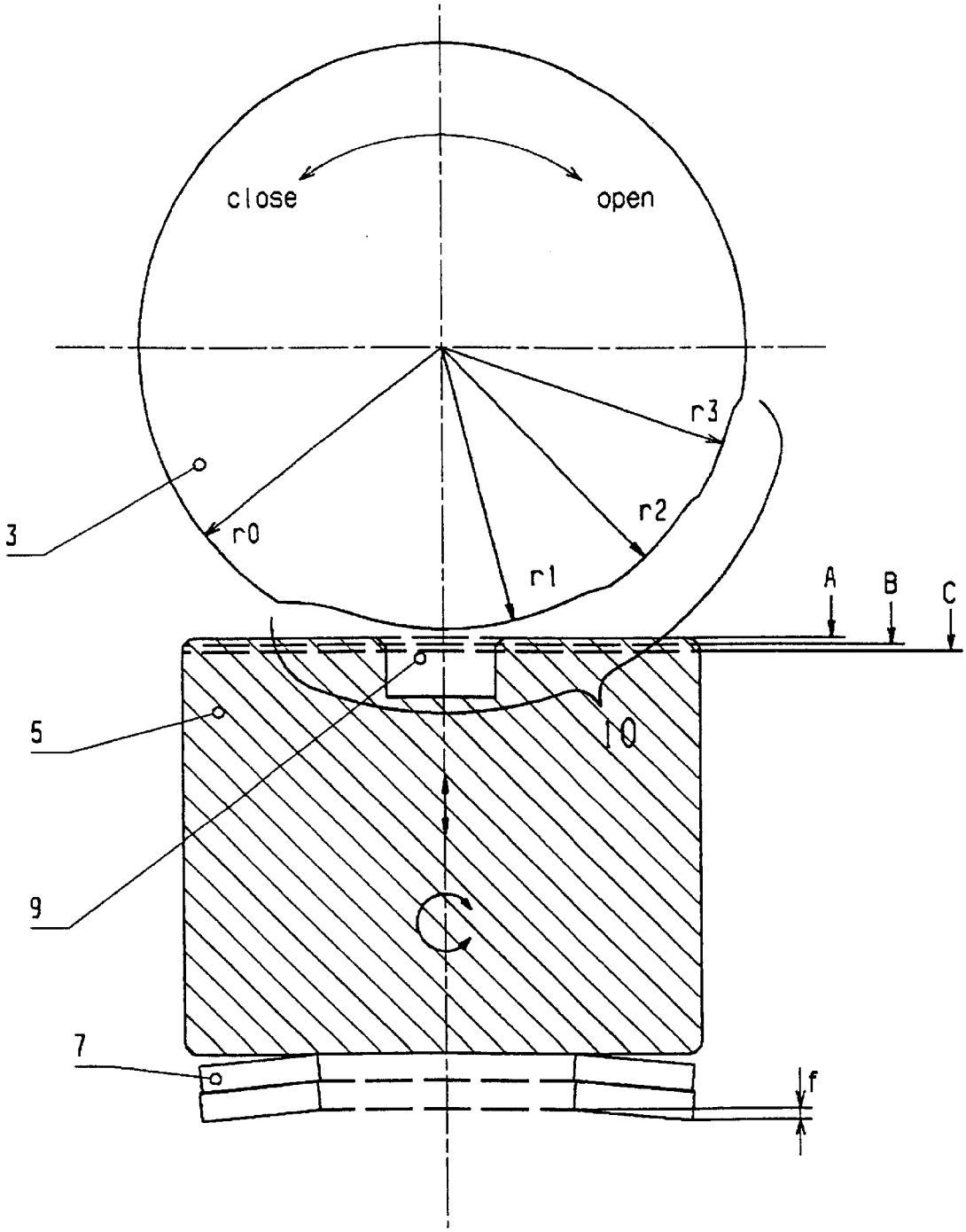
FIG. 6 shows an enlarged illustration of FIG. 4.

In FIG. 6, the parts which interact for the infinitely variable fixing of the door, the compression spring 7, pressure ram 5 and hinge shaft 3, are illustrated in a similar manner to in FIG. 4, but on a clearly enlarged scale. A blind hole 9 is embedded centrally in the end surface of the pressure ram 5. Over the circumferential section 10, the hinge shaft 3 has an outer profiling, the contour of which is formed from sectors having graduated circle radii which are smaller than the shaft radius $r_0$ and become respectively smaller in the sequence $r_3$ to $r_2$ to $r_1$. The transitions between the sectors having a different radius are very gentle. The differences in radii between adjacent sections are minimal and change continuously. The tangent on the respective graduating circle radius remains free from the adjacent shaft contours. The sector having the graduated circle radius $r_1$, corresponds to the closing position of the door. The graduated circle radius $r_1$, is smaller by at least the spring travel f than the graduated circle radius $r_2$ of the adjacent sector. At the top on the right-hand side next to the pressure ram 5 the pressure ram positions A, B and C are illustrated, the pressure ram position A corresponding to the closing position and therefore to the position during the interaction with the graduated circle radius $r_1$. Pressure ram position B corresponds to the position during interaction with the sector having the graduated circle radius $r_2$. Pressure ram position C corresponds to the position during the interaction of the pressure ram 5 with the sector having the graduated circle radius $r_3$. In the hinge shaft 3, a rotational arrow for the closing direction and the opening direction is indicated. As has been shown in tests, the pressure ram 5 rotates continuously about its own axis during the interaction with the hinge axis 3. This rotation can be attributed to the fact that despite exact dimensions and installation dimensions extremely small tolerances are in play and have the effect that the forces between the respectively mutually symmetrical sections of the interacting parts are not absolutely the same. As a result, the forces do not nullify one another. If the blind hole in the end surface of the pressure ram 5 is arranged offset eccentrically by less than its radius, it nevertheless remains ensured that the line of contact between the pressure ram 5 and profiled contour crosses the blind hole 9.

On the other hand, this further reinforces the difference of the forces between the interacting sections and assists the rotation of the pressure ram 5.

Figure 8:
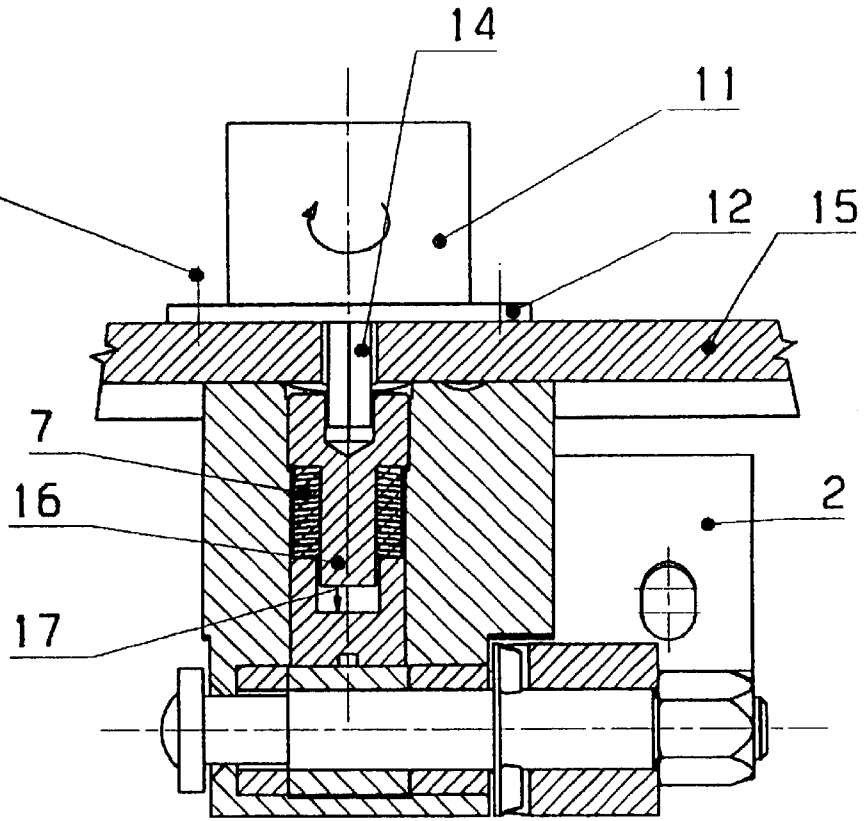
FIG. 8 shows a sectional view as in FIG. 2, but with a motor.
Figure 7:
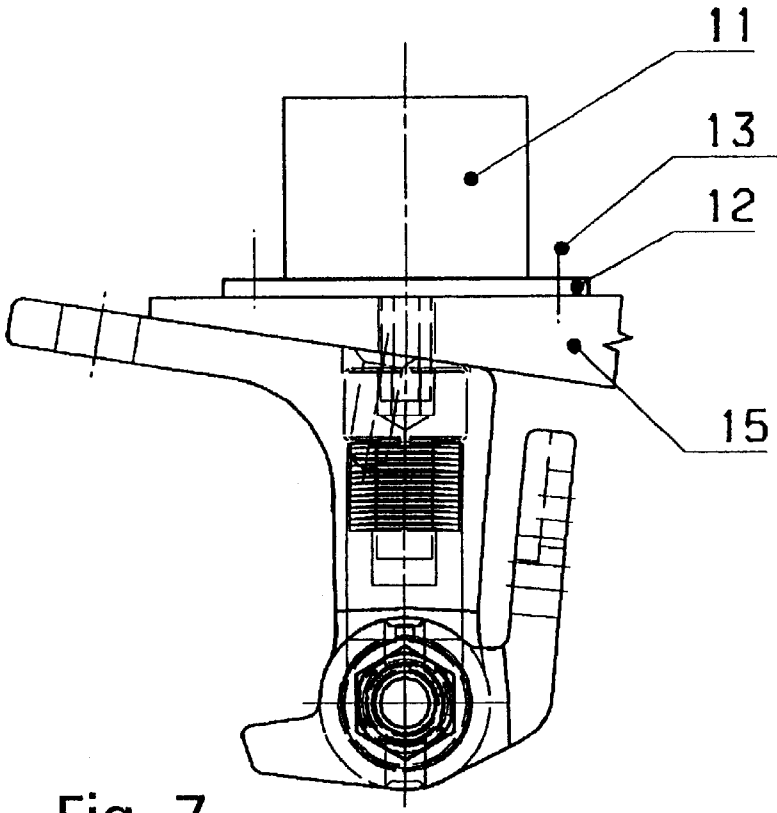
FIG. 7 shows a plan view of a door hinge with a motor, similar to the illustration in FIG. 1.

In the figures FIG. 7 and FIG. 8, a hinge with an integrated door stop and a motor 11 which is arranged on the bodywork and interacts with the threaded cylinder 8 is illustrated in a comparable illustration to the ones in FIG. 1 and FIG. 2. In this case, the motor flange 12 is attached fixedly via fastening devices 13 to the adapter plate 15 which is arranged between the bodywork and the tab of the bodywork hinge part 1. It can clearly be seen in FIG. 8 that a driver is formed on the motor shaft 14, the said driver engaging into the screw profile embedded in the end surface of the threaded cylinder 8. The cup spring 7 has a central opening into which a pin 16 which is formed on the end of the threaded cylinder 8 protrudes flush with the edge. The pin 16 can enter into the blind recess 17 embedded in the back of the pressure ram 5.

Figure 9:
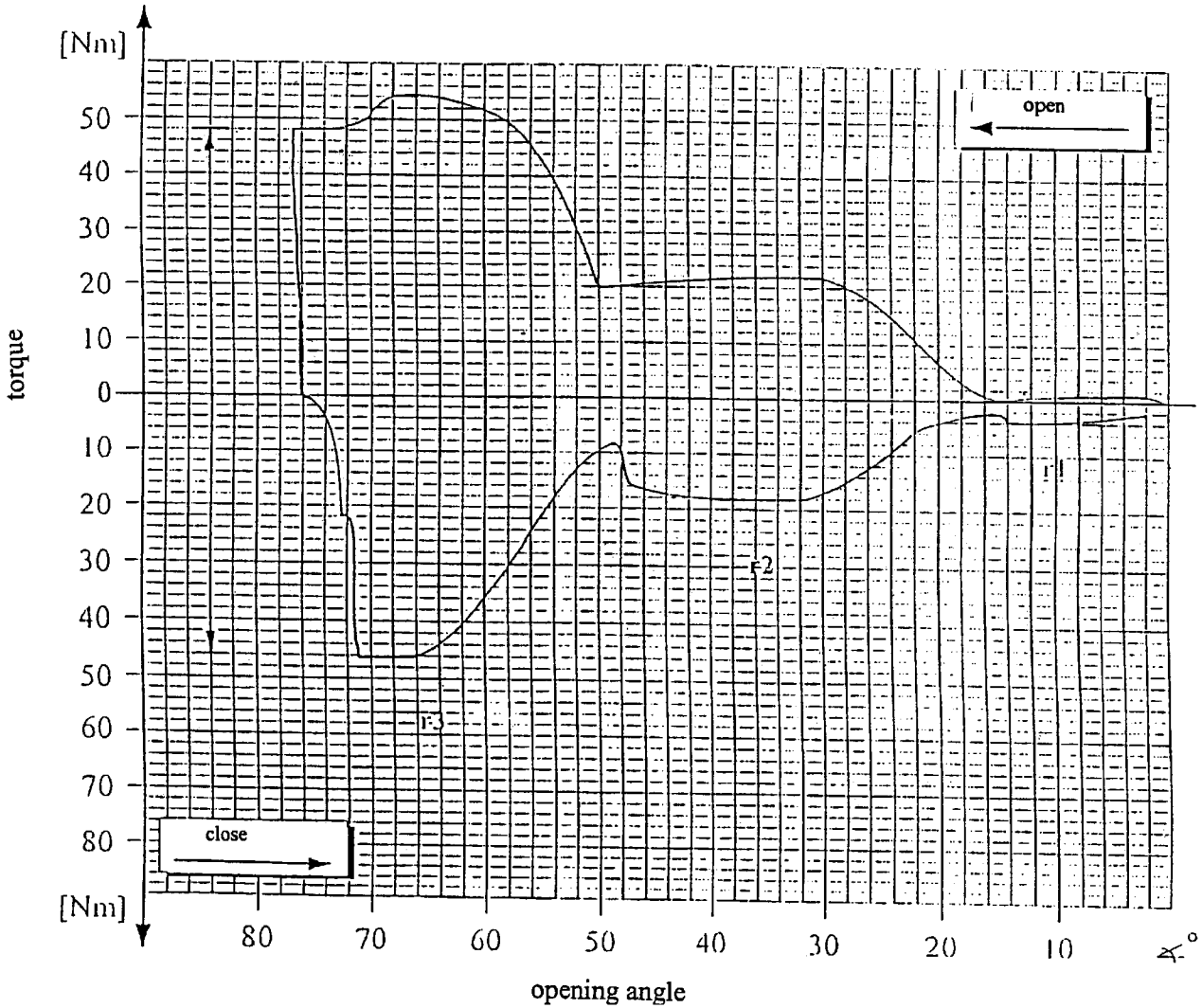
FIG. 9 shows an illustration of the torque during opening and closing of a motor vehicle door as a function of the opening position when the infinitely variable door stop according to the invention is used.

In FIG. 9, the torques which occur during opening and closing of a motor vehicle door are plotted as a function of the opening position or angular position of the door. The torques which are plotted have resulted in each case during opening and closing of the door in tests at constant angular velocity. In the illustration, the closing position of the door is on the right-hand side, ie at the opening angle 0, while the open position of the door is on the left-hand side of the diagram at the opening angle 90°. The torque profile during the opening is illustrated in the upper half of the illustration and the torque profile during the closing of the door is illustrated in the lower part. The torques which are plotted arise when the profile illustrated in FIG. 4 and FIG. 6 is used, the graduated circle radii r1, r2 and r3, which correspond to the respective position regions, being indicated. During the opening, initially in the region r1 up to an opening angle of approximately 15° virtually no torque is required. Only at an opening angle of approximately 20° does the end surface of the pressure ram 5 come into the region of the graduated circle radius r2, with the result that during the further opening the torque increases to approximately 20 Nm and opening angles in the pivoting region between approximately 30° and 50° remain approximately constant at this level. Subsequently, the ram end comes into the region of the graduated circle radius r3, with the result that during the further opening the torque is increased to approximately 50 Nm and remains there up to an opening position of approximately 85°. During the closing, torques of approximately the same size in the other direction of rotation over the corresponding regions are required in the respective sectors. At an opening position which corresponds to the opening angle of approximately 15°, the ram end comes again into the region of the graduated circle radius r1, with the result that virtually no torque occurs. The level of the torque profile can be increased or reduced both in the opening direction and in the closing direction if the prestress of the spring 7 is 25 changed by appropriate setting of the threaded cylinder 8.

List of Reference Numbers

1 Bodywork hinge part
2 Doorhinge part
3 Hinge shaft
4 Latching sleeve
5 Pressure ram
6 Guide bushings
7 Spring element
8 Threaded cylinder
9 Blind hole, pressure ram
10 Contour, profiled circumferential section
11 Motor
12 Motor flange
13 Fastening
14 Motor shaft with driver
15 Adapter plate on bodywork

16 Pin
17 Blind recess
r Radius
R Latching mark, latching region
f Spring travel
F Spring force

What is claimed is:

1. A door hinge for a vehicle door, the door hinge comprising:

a first hinge half for fastening to one of the door and door pillar and a second hinge half for fastening to the other of the door and door pillar, the first hinge half having a first lug and a hole, and the second hinge half having a second lug;

a hinge shaft held in the first lug with a running fit and in the second lug in a rotationally secure manner, the hinge shaft connecting the first and second hinge halves pivotably to each other, the hinge shaft having a profiled circumferential section and a pivot axis;

an integrated door stop unit having a pressure ram and a spring, the pressure ram and the spring being secured in the hole of the first hinge half, the door stop unit for fixing the first hinge half with respect to the second hinge half through prestressing of the spring, the spring pushing the pressure ram against the profiled circumferential section of the hinge shaft, the pressure ram interacting with the profiled circumferential section along a line of contact so as to define a frictional force for the door hinge, the pressure ram having an end surface the end surface, the end surface being planar, the pressure ram running parallel to the pivot axis and being mounted rotatably in the hole, the hole being arranged radially with respect to the pivot axis, the end surface having a blind hole, the line of contact by the hinge shaft on the end surface crossing the blind hole.

2. The door hinge as claimed in claim 1 wherein the profiled circumferential section of the hinge shaft includes a plurality of sectors situated peripherally next to one another having contours matched to the end surface of the pressure ram, the profiled cicumferential section having, over at least one sector, a graduated circle contour having a smaller radius in comparison with a front sector in the opening direction of rotation of the door, the transition from one sector to the next being smooth.

3. The door hinge as claimed in claim 2 wherein the sectors correspond to door position regions, and a radius of the sector corresponding to a closing position of the door is smaller by at least an amount corresponding to a spring travel of the spring than a radius of the adjacent sector.

4. The door hinge as claimed in claim 1 wherein the blind hole has a radius, wherein the radius is less than a length of the line of contact crossing the blind hole, and wherein the blind hole is offset eccentrically in the end surface by less than the radius of the blind hole.

5. The door hinge as claimed in claim 1 wherein an end of the hole facing away from the hinge shaft is closed by a threaded cylinder guided moveably in an internal thread, and the spring is arranged between the pressure ram and the threaded cylinder, the hole being accessible from an outside of the hinge.

6. The door hinge as claimed in claim 1 wherein the profiled circumferential section is arranged at least on a quarter of a shaft circumference in a region of the radial hole and has contours at a smaller distance from the pivot axis than a shaft radius.

7. The door hinge as claimed in claim 1 wherein the hinge shaft has stepped, cylindrical sections including an upper section, a central section and a collar-shaped section of larger diameter being arranged between the upper, and central section and a pin having a smaller diameter being arranged at a lower end, the collar-shaped section being supported on an end joint of the first hinge half with a running fit.

8. The door hinge as claimed in claim 1 wherein the hinge shaft has an axially running outer profile in a central section and has an external, single- or multi-part sleeve having an inner profile matched in a form-fitting manner to an outer profile of an interior of the shaft, at least a subsection of the sleeve having the profiled circumferential section, the subsection of the sleeve being a single-piece latching sleeve.

9. The door hinge as claimed in claim 1 wherein the spring has a central opening, a pin being arranged in the central opening on the end of a threaded cylinder in the hole or on a back of the pressure ram, a blind recess corresponding to the pin cross section being present in the pressure ram if the pin is on the threaded cylinder or in the threaded cylinder if the pin is on the back of the pressure ram.

10. The door hinge as claimed in claim 9 wherein the spring is a cup spring, a diaphragm spring, an annular spring or a helical spring.

11. The door hinge as claimed in claim 1 further comprising a motor arranged on the first hinge half with a running fit in such a manner that a drive shaft of the motor engages into a screw profile of a threaded cylinder in the hole.

* * * * *